US007757454B2

(12) United States Patent
Smith

(10) Patent No.: US 7,757,454 B2
(45) Date of Patent: Jul. 20, 2010

(54) COMPOSITE BUILDING PANEL AND METHOD OF MAKING COMPOSITE BUILDING PANEL

(75) Inventor: Brian Smith, Encinitas, CA (US)

(73) Assignee: Ecolite International, Inc., Encinitas, CA (US)

( * ) Notice: Subject to any disclaimer, the term of this patent is extended or adjusted under 35 U.S.C. 154(b) by 932 days.

(21) Appl. No.: 10/565,317

(22) PCT Filed: Jul. 21, 2004

(86) PCT No.: PCT/US2004/023155

§ 371 (c)(1),
(2), (4) Date: Jan. 19, 2006

(87) PCT Pub. No.: WO2005/010291

PCT Pub. Date: Feb. 3, 2005

(65) Prior Publication Data

US 2007/0062151 A1 Mar. 22, 2007

Related U.S. Application Data

(60) Provisional application No. 60/488,821, filed on Jul. 21, 2003.

(51) Int. Cl.
*E04B 5/04* (2006.01)

(52) U.S. Cl. ..... 52/601; 52/315; 52/649.1

(58) Field of Classification Search ..... 52/414, 52/630, 601, 315, 649.1, 745.05
See application file for complete search history.

(56) References Cited

U.S. PATENT DOCUMENTS 1,399,088 A 12/1921 Seymour
1,593,831 A 7/1926 King
1,685,247 A * 9/1928 Selway ..... 52/356
1,955,584 A 4/1934 Henderson
1,997,809 A 4/1935 Cole
2,807,070 A 9/1957 Thomas (Continued)

FOREIGN PATENT DOCUMENTS

GB 1162518 8/1969

(Continued)

OTHER PUBLICATIONS

Pamphlet: "Gain a Competitive Edge", Simple Building Systems Inc.

(Continued)

*Primary Examiner*—Basil Katcheves
(74) *Attorney, Agent, or Firm*—Greer, Burns & Crain, Ltd.

(57) ABSTRACT

A composite panel and method of fabricating is provided which includes a frame having a plurality of spaced apart frame members, and a concrete slab made of aerated concrete having a density of 400 to 1760 kg/m$^3$ (25 to 110 pcf) pounds per cubic foot. Fastened to the frame members is a reinforcing layer. The concrete slab, having a front face and a rear face, embeds the reinforcing layer and a portion of the frame such that the frame protrudes from the rear face of the slab. At least one tab and one tab opening is disposed on an embedded portion of the frame, and the concrete slab extends through the tab opening.

6 Claims, 9 Drawing Sheets

U.S. PATENT DOCUMENTS

| | | | | |
|---|---|---|---|---|
| 3,484,999 | A | 12/1969 | Van Der Lely | |
| 3,604,174 | A | 9/1971 | Nelson | |
| 3,802,147 | A | 4/1974 | O'Konski | |
| 4,573,304 | A | 3/1986 | Mieyal | |
| 4,602,467 | A | 7/1986 | Schilger | |
| 4,649,682 | A * | 3/1987 | Barrett, Jr. | 174/480 |
| 4,909,007 | A | 3/1990 | Bodnar | |
| 4,930,278 | A | 6/1990 | Staresina et al. | |
| 5,335,472 | A | 8/1994 | Phillips | |
| 5,414,972 | A * | 5/1995 | Ruiz et al. | 52/600 |
| 5,494,513 | A * | 2/1996 | Fu et al. | 106/672 |
| 5,526,629 | A * | 6/1996 | Cavaness | 52/745.19 |
| 5,758,463 | A | 6/1998 | Mancini, Jr. | |
| 6,401,417 | B1 | 6/2002 | LeBlang | |
| 6,494,008 | B1 | 12/2002 | Bloem et al. | |
| 6,508,043 | B1 | 1/2003 | Bond et al. | |
| 6,668,507 | B2 | 12/2003 | Blanchet | |
| 6,708,459 | B2 * | 3/2004 | Bodnar | 52/356 |
| 2002/0153469 | A1 | 10/2002 | Eyring et al. | |
| 2003/0141624 | A1 | 7/2003 | Takagi et al. | |

FOREIGN PATENT DOCUMENTS

| | | |
|---|---|---|
| GB | 2 395 731 | 6/2004 |
| WO | WO 94/15037 | 7/1994 |

OTHER PUBLICATIONS

Brochure: "Metal Stud Crete®, Thin Shell Concrete and Steel Stud Structural Wall System", Earl Composite Systems.
Magazine Advertisement: "Slender Wall®, Architectural Precast Concrete/Steel Stud Building Panels".

* cited by examiner

COMPOSITE BUILDING PANEL AND METHOD OF MAKING COMPOSITE BUILDING PANEL

This is a U.S. National Stage application of International PCT Application No. PCT/US2004/023155, filed on Jul. 21, 2004, which claims priority to U.S. Provisional Application No. 60/488,821, filed Jul. 21, 2003, now abandoned.

BACKGROUND OF THE INVENTION

The present invention relates to a composite concrete and metal building panel and a method for making the same. More particularly, the present invention relates to an improved composite panel having a metal stud frame structure with a molded concrete panel in which the metal stud frame is partially embedded in the concrete.

Composite concrete and steel frame panels have been used to construct floors, walls and ceilings in buildings, and as cladding panels in high-rise structures. It is well known to assemble composite building panels at one location and to transport the product to a construction site for use in fabricating structures. The use of prefabricated building components substantially reduces the labor costs at both the manufacturing and assembly processes.

Wood frames are commonly used in the building industry. Wood has the disadvantages of being susceptible to rotting and termite damage, and in addition, is highly flammable. For these reasons, wood typically has a lower potential life-span than other building materials.

On the other hand, concrete has a relatively longer life-span. Suited for very high compressive load bearing applications, concrete is a readily available building material. However, since concrete has a relatively low tensile strength, it is necessary to use metal reinforcement to improve the tensile strength of the panel if the panel is intended to carry load.

Composite panels made of concrete and metal frames are well known for providing exterior wall systems for commercial and industrial buildings, high-rise office buildings, and other applications. In most cases, the panels are supported on the building structure, and are not intended to bear any loading other than wind loading, however composite panels can also be used in load bearing applications. Generally, the panel includes a finished concrete surface forming the exterior of the building, and an interior surface for installation of insulation and finishings for the interior of the building. Structural steel studs, such as C-shaped channels, are assembled into a frame and the frame is partially embedded into a concrete slab. Embedding the frame into the concrete is typically accomplished by pushing the frame into the poured concrete and vibrating the concrete, or by attaching the frame to a jig or to conventional forms such that the frame is held supported a distance above the pouring pad. In the latter method, the concrete is poured and the jig or the forms are removed when the concrete is cured. A reinforcing layer, such as reinforcing mesh, is usually embedded in the concrete adjacent the channel to provide additional support to the frame.

U.S. Pat. No. 3,484,999 to C. Van Der Lely discloses a reinforced concrete slab for a wall, floor or roof. A frame of C-channel beams is located at the periphery of the slab, with the channels being partially embedded in the slab. A plurality of ribs are also partially embedded in the slab and are connected to a reinforcing member in the slab and to the peripheral frame. The panel is fabricated by placing the frame assembly on a jig and casting the concrete on a vibrating table to obtain a compact structure. When the concrete is cured, the panel is removed from the jig.

Staresina et al. disclose a composite building panel having a C-channel stud framework and a slab of cementious fiber reinforced material in U.S. Pat. No. 4,930,278. A flange of the C-channel abuts the surface of the slab such that a plurality of L-shaped tabs formed in the flange protrude into the slab. The panel is manufactured by pushing the frame down into the freshly poured concrete.

U.S. Pat. No. 5,526,629 to Cavaness discloses a composite building panel having a frame assembly around the perimeter of the panel and metal studs arranged within the bounds of the frame assembly. Having a general C-channel shape, one flange of the channels is embedded in a concrete slab. While the front of the panel is defined by the planar surface of the concrete slab, the back of the panel has the remaining portion of the C-channels protruding from the concrete. The remaining portions of the C-channels are used to join one panel to the next panel during installation on a building.

The Cavaness panel is manufactured by placing the assembled frame on a pouring pad and attaching form members (for example, wooden boards) around the perimeter. Concrete is poured from the rear of the panel until the concrete reaches a depth which embeds the flange. When the concrete is cured, the forms are disassembled.

Among the disadvantages of these composite panels, as well as other composite panels, is that the concrete slab is heavy. Consequently, the panels have to be thin in order to make them a feasible building alternative.

A further disadvantage of metal reinforced composite panels is that a line of weakness is created when the reinforcement abuts the channel, or other structural member.

Another disadvantage of metal reinforcement in concrete panels is that the metal located at the inner surface of the concrete can be exposed to moisture, which can lead to rust and mold, which is undesirable and costly to remedy.

A further disadvantage of metal reinforcement in concrete panels is that the embedded metal can shear the concrete from inside of the panel, particularly if the metal is not sufficiently anchored in the panel, causing the panel to fail.

Another common disadvantage of the concrete panel is that they have poor thermal and acoustic insulation properties.

Accordingly, there is a need to provide an improved composite panel and method of making in which the panel may be prefabricated at the construction site or elsewhere and transported to the construction site.

Another need is for an improved composite panel and a method of making in which the panel is strong, lightweight, fire resistant, thermally insulating, seismically resistant, sound attenuating and resistant to dampness, mold and rust.

A further need is for an improved composite panel and method of making in which the panel affords designers considerable latitude in the design, placement, and appearance of the panel.

Yet another need is for an improved composite panel and method of making in which the method of manufacture is less labor intensive than conventional composite panels.

BRIEF SUMMARY OF THE INVENTION

Accordingly, many of the above-listed needs are addressed by the present composite building panel and method of making the same. More specifically, the present invention provides a prefabricated composite panel having a frame including a plurality of spaced apart frame members and a reinforcing layer fastened to the frame members, embedded in a generally planar concrete slab preferably made of aerated concrete having a density of 400 to 1760 kg/m$^3$ (25 to 110 pcf). Both the reinforcing layer and a portion of the frame are embedded in the concrete slab. A portion of the frame protrudes from a rear face of the concrete slab.

In another embodiment, a prefabricated composite panel includes a concrete slab and a frame having a plurality of spaced apart frame members. The frame members are partially embedded in the concrete slab. There is at least one tab and one tab-opening disposed on the embedded portion of the frame members and the concrete extends through the tab-opening.

Another prefabricated composite panel includes a frame having a plurality of spaced apart frame members and a generally planar concrete slab. The concrete slab embeds a portion of the frame, and a portion of the frame which is not embedded protrudes from a rear face of the concrete slab. Further, there is at least one outer member removably fastened to the frame and configured to retain the concrete within an area bounded by the outer member.

A method of fabricating a composite building panel includes attaching at least one outer member to a frame so that the outer member is oriented upside down. The frame and the outer member are flipped over generally 180-degrees so that the outer member is oriented right side up. The outer member and the frame are placed on a pouring pad and a concrete slurry is deposited to a depth such that a portion of the frame is embedded in the concrete. Curing of the concrete occurs thereafter.

DETAILED DESCRIPTION OF THE INVENTION

Figure 1:
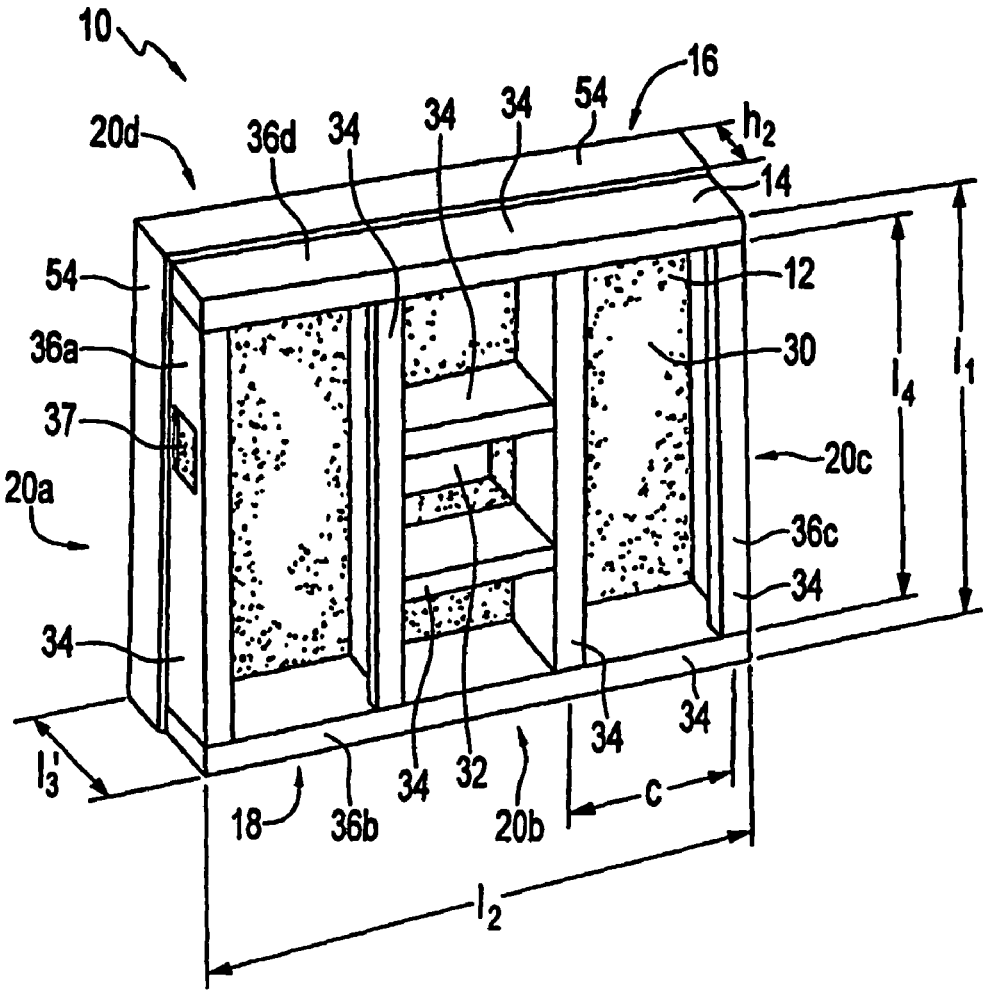
FIG. 1 is a rear perspective view of a composite panel of the present invention.
Figure 4:
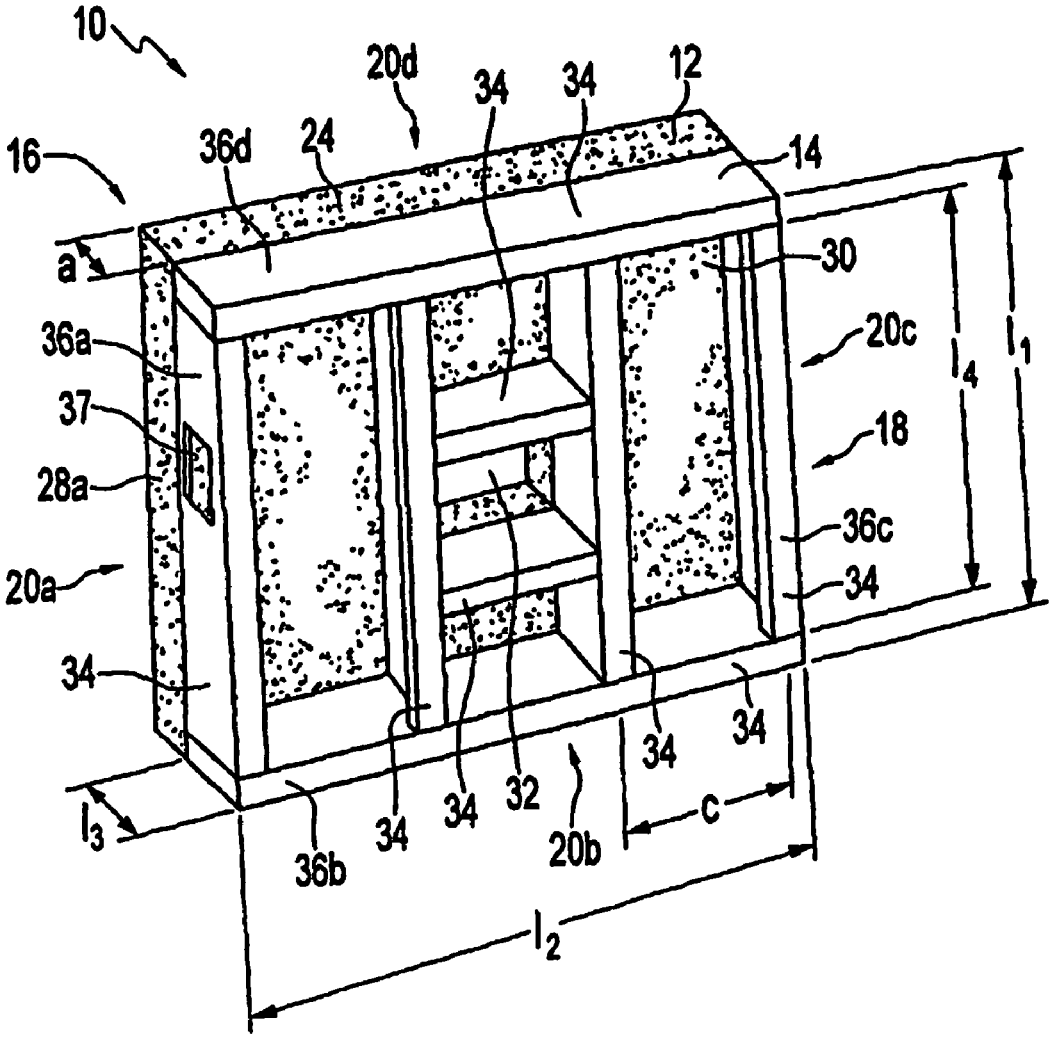
FIG. 4 is a rear perspective view of the composite panel of FIG. 1 with the outer members removed.

Referring to FIGS. 1 and 4, a composite building panel for use in the construction of a structure is generally designated 10. The composite building panel 10 includes a concrete slab 12 and a metal stud frame 14 in which a portion of the frame is embedded in the concrete slab. Preferably, the composite panel 10 is prefabricated and then attached to other composite panels to form a structure. Each composite panel 10 has a front face 16, a rear face 18, and a plurality of side edges 20*a*, 20*b*, 20*c*, 20*d*.

Figure 2:
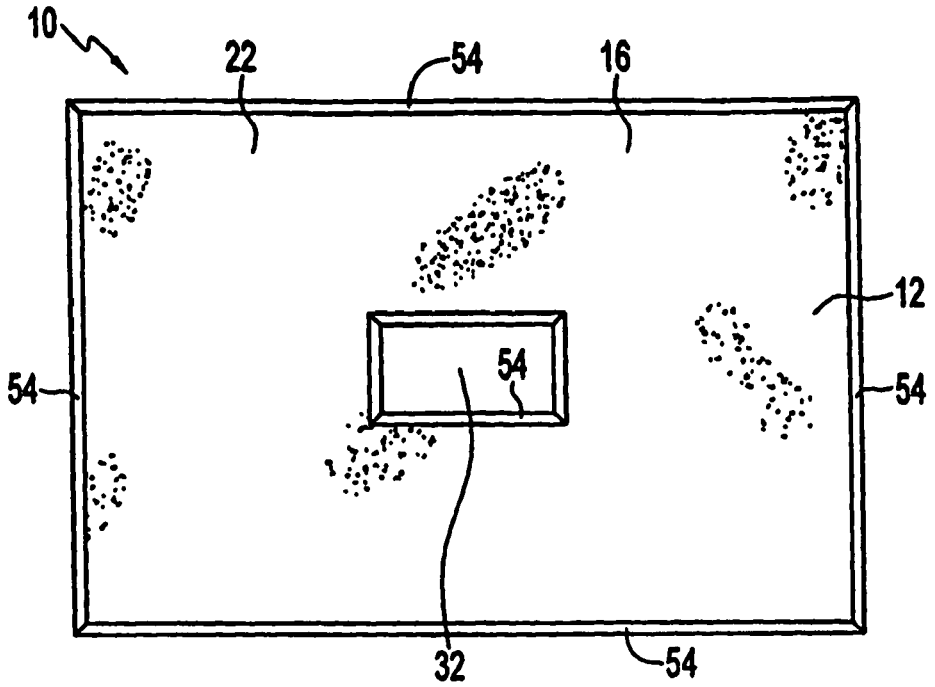
FIG. 2 is a front elevational view of the composite panel of FIG. 1.
Figure 5:
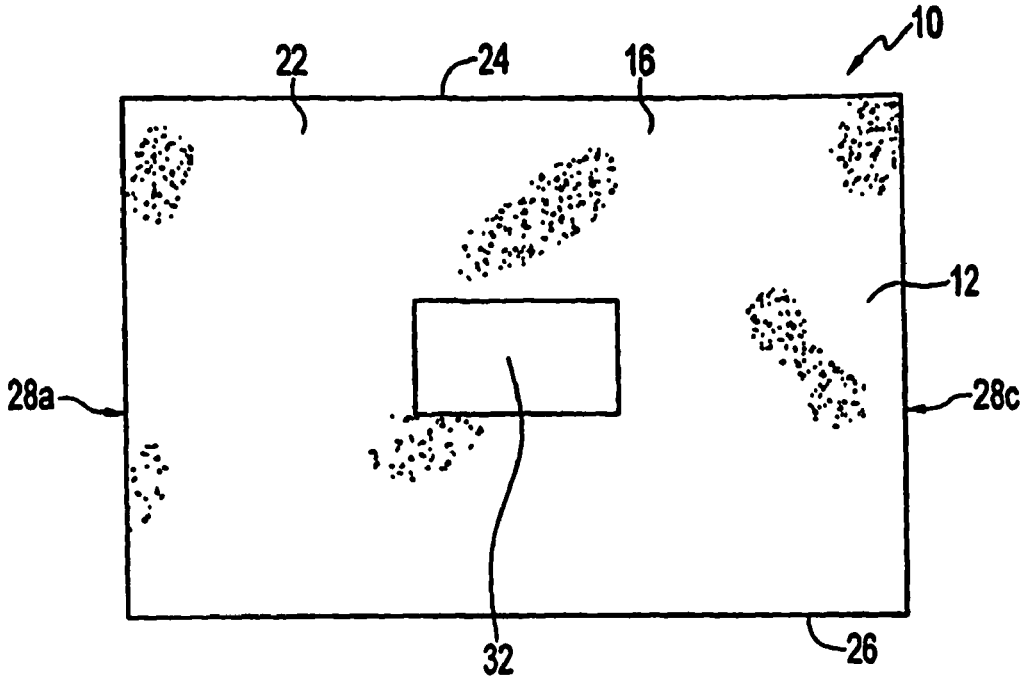
FIG. 5 is a front elevational view of the composite panel of FIG. 1 with the outer members removed.

As seen in FIGS. 2 and 5, generally the concrete slab 12 is located towards the front face 16 of the composite panel 10. Preferably, the concrete slab 12 has a generally planar front surface 22 defined between a top edge 24, a bottom edge 26, and first and second side edges 28*a*, 28*c*. The concrete slab 12 also has a back surface 30 from which the partially embedded metal frame 14 protrudes. Since concrete has high compressive strengths, but low tensile strengths, the frame 14 is required for reinforcing the panel 10. The metal frame 14 is preferably made of steel, however, it is also contemplated that the frame can be made of other types of metal or rigid material such as fiber glass and carbon fiber composites.

The concrete slab 12 is preferably made of lightweight or aerated concrete. For purposes of this patent application, conventional concrete has a cured density of about 2400 kg/m$^3$ (150 pcf), while lightweight concrete has a cured density of about 1922 kg/m$^3$ (120 pcf) or less. Aerated concrete, or foam concrete, is a species of lightweight concrete typically having a cured density of about 160 to 2243 kg/m$^3$ (10 to 140 pcf). In aerated concrete, a homogenous void or cell structure is attained with gas-forming chemicals, foaming agents, or any other method for entraining gas. Entraining air, or other gases such as hydrogen or oxygen, into the concrete lowers the density of aerated concrete while improving workability.

Foaming agents used to entrain gas into the concrete are either natural protein foaming agents or synthetic foaming agents. Foaming agents are generally diluted with water to a predetermined ratio, depending on the desired density of the aerated concrete. Typically, the ratio of water to foaming agent is about 40:1 for protein foams, and 25:1 for synthetic foams, to get an aerated concrete of about 400 to 1762 kg/m$^3$ (25 pcf to 110 pcf).

Natural protein foaming agents are preferred to synthetic agents because a more durable "bubble" is produced, resulting in a higher percentage of air entrainment in the concrete. Although introduction of a foaming agent into the concrete is the preferred method of air entrainment, it is contemplated that other methods of air entrainment may be used.

Conventional applications of aerated concrete have largely been limited to horizontal applications such as fill, slabs and floors. However, it has been discovered that aerated concrete is advantageous in building panels that can be placed vertically as well as horizontally. Although it should be appreciated that this application is not restricted to lightweight or aerated concrete, the use of these materials leads to increased benefits, particularly when used as a cladding panel on a high rise building. Aerated concrete affords good properties of thermal insulation, fire protection, seismic protection and sound attenuation.

Since aerated concrete can be manufactured to have a casting density of around 400 to 1760 kg/m$^3$ (25 to 110 pcf), it is about 33% to 87% lighter than standard dense concrete. A range of 400 to 1762 kg/m$^3$ (25 to 110 pcf) is generally suitable for practicing the present invention, however, a preferred density for the panel 10 is generally about 960 to 1200 kg/m$^3$ (60 to 75 pcf). Further, a most preferred density for the panel 10 is generally about 1200 kf/m$^3$ (75 pcf). Generally, the less dense the concrete, the more fluid and the more workable the concrete is. For example, aerated concrete can be self-leveling upon pouring, can be sawn by hand, sculptured, and troweled, and can be penetrated by standard fasteners.

The strength of aerated concrete is generally dependent on the density. Preferably, the aerated concrete slurry will range in strength from 3.45 to 20.07 kPa (500 to 3000 psi) depending on the air content, although other strengths are contemplated to suit the application. While lower than the strength of conventional dense concrete, aerated concrete is strong enough to withstand typical loadings encountered in building panel design.

Aerated concrete is also highly fire resistant, which lends itself to building panel applications, especially for large buildings where high fire rating standards are imposed. Not only are there safety benefits, but the aerated concrete will dampen the effects of temperature fluctuation on the reinforcing metal, which will in turn mean a longer useful life of the panel.

Another characteristic of aerated concrete is that it has improved insulation and low thermal conductivity properties. When a material such as polystyrene is added to the aerated concrete mix, the thermal insulation characteristic of aerated concrete can be further improved. Another characteristic which makes aerated concrete particularly advantageous over standard dense concrete in building panel applications is the high sound absorption capacity.

As is known in the art, aerated concrete is made by first forming a mortar slurry by mixing predetermined quantities of water, cement, sand and/or fly ash. Additionally, polystyrene, cork, polypropylene, cryogenic crumbed rubber, vermiculite, recycled polystyrene, recycled domestic rubbish and recycled plastic materials can by added, among other materials such as retardants and water reducers. In particular, materials such as fly ash, recycled polystyrene, recycled domestic rubbish and recycled plastic materials make the concrete more environmentally friendly than conventional concrete. When the materials are mixed to a completely mixed consistency, a predetermined amount of foaming agent is introduced.

A foam generator is used to produce foam, preferably having a consistency similar to shaving cream, from the foaming agent. The foam is injected into the concrete mixer in predetermined amounts to obtain a predetermined casting density. Once thoroughly mixed, the slurry is very light and fluid as compared to conventional concrete, and can be easily poured or pumped. As is known, the material properties of the aerated concrete are determined by the mix design of the mortar slurry, the amount and type of the foam blended into it, and the way in which the concrete is mixed, among other things.

Figure 3:
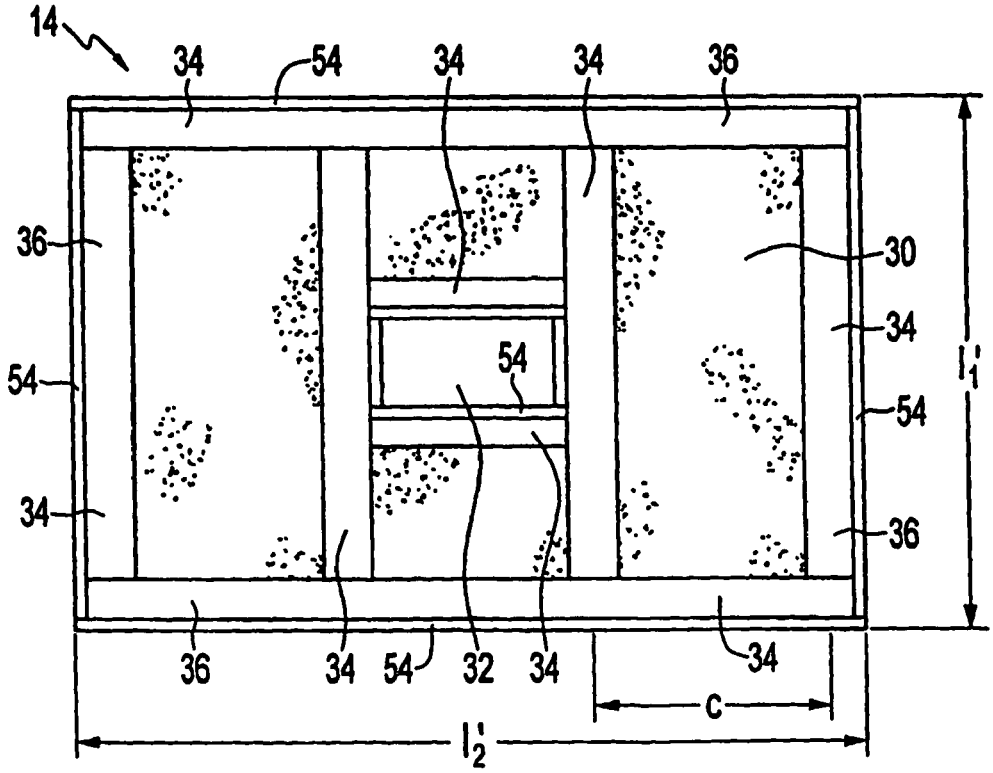
FIG. 3 is a rear elevational view of a frame and outer members of the composite panel of FIG. 1.
Figure 6:
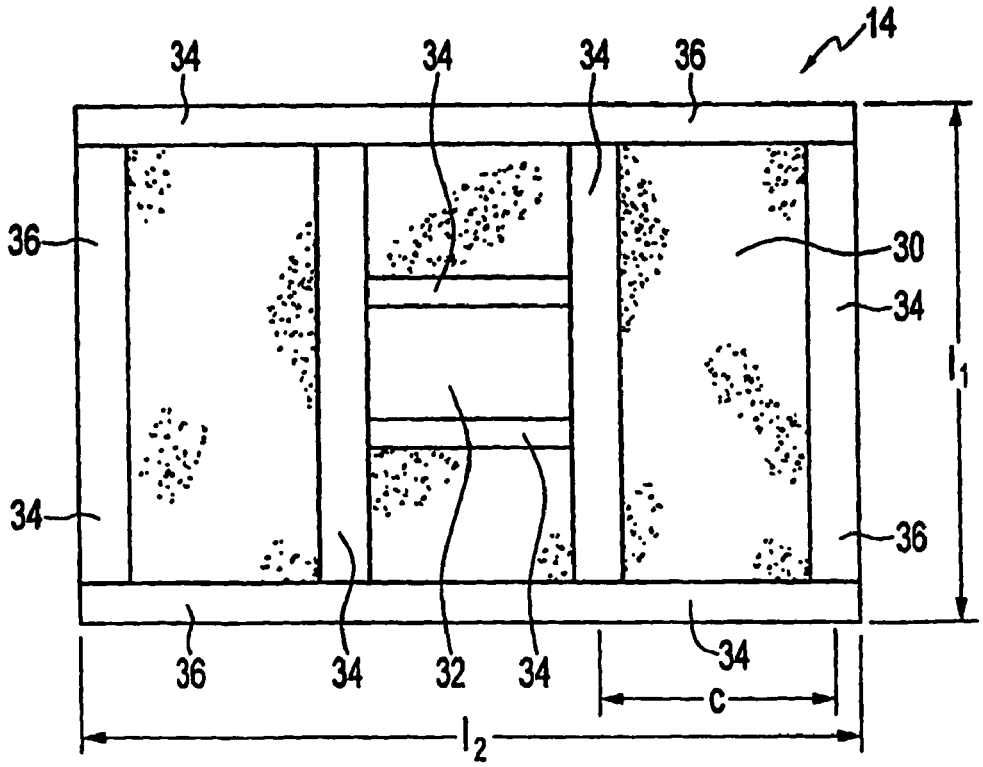
FIG. 6 is a rear elevational view of the composite panel of FIG. 1 with the outer members removed.

Referring to FIGS. 3 and 6, the frame 14 is embedded in the rear face 18 of a concrete slab 12. When the panel 10 is installed on a building, the frame 14 is oriented towards the interior side of the structure and the concrete slab 12 is oriented towards the exterior side of the structure. The exposed frame 14 provides cavities for the installation of plumbing, electrical wiring and insulation. The overall shape of the frame 14 is preferably a rectangle, but may be of any desired shape. It is also contemplated that the frame 14 may have openings 32 where concrete is removed or not poured, such as for doors, windows or ventilation openings, as is known in the art.

The frame 14 preferably is made of a plurality of C-channel frame members 34, but can include different types of frame members, such as metal studs, or any other shaped members. Peripheral frame members 36*a*, 36*b*, 36*c*, 36*d* define the periphery of the frame 14. Preferably, the peripheral frame members 36*a*, 36*b*, 36*c*, 36*d* define a first length $l_1$ a second length $l_2$, and a third length $l_3$ of the frame 14, however it is contemplated that the frame can be of any desirable shape and dimension. Further, it is contemplated that the frame members 36 may have openings 37 within the member to allow electrical wiring, plumbing and the like to pass therethrough.

Figure 7:
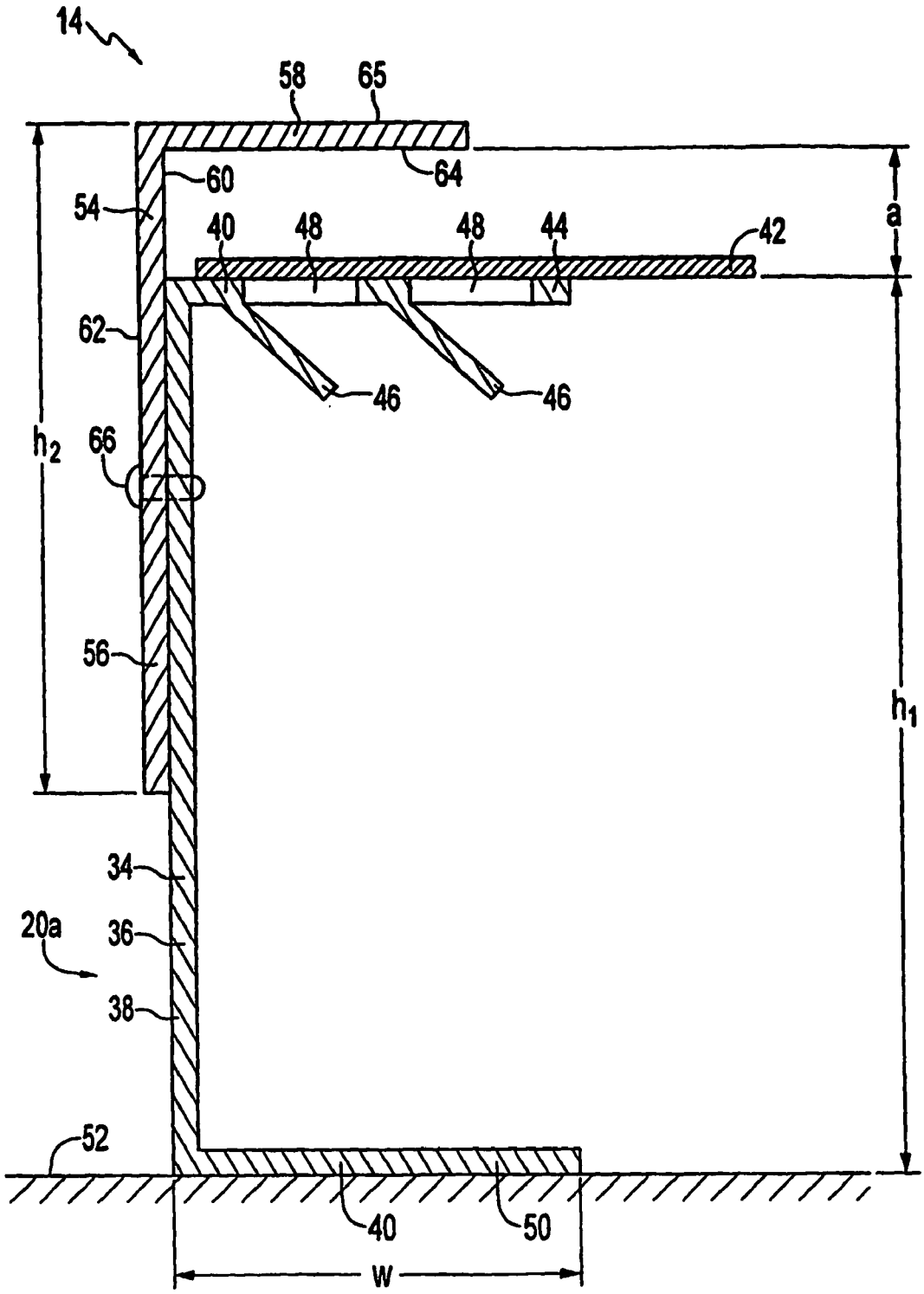
FIG. 7 is a partial cross section of the outer member attached to the frame for a composite panel of FIG. 1.

In the preferred embodiment and as seen in FIG. 7, the elongate frame members 36 are C-channels including a web portion 38 and two opposing flanges 40 projecting normally from each end of the web, as is known in the art with respect to C-channels. Having a length $l_4$ defined by the dimension normal to the C-shape (FIG. 1), a height $h_1$ defined between the two opposing edges of the web 38 on which the flanges 40 are disposed (FIG. 7), and a width w defined by the distance between the outside edge of the web and the outside edge of each flange (FIG. 7), each frame member 34 is preferably arranged and attached to at least one other frame member to form the frame 14. The frame members 34 are preferably assembled in the frame 14 a common distance apart c (FIGS. 3 and 6), such as 40 or 61 cm (16 or 24 inches), which is a common distance in the building industry to allow for finishing. However, non-uniform distances are also contemplated to suit the application.

Figure 8:
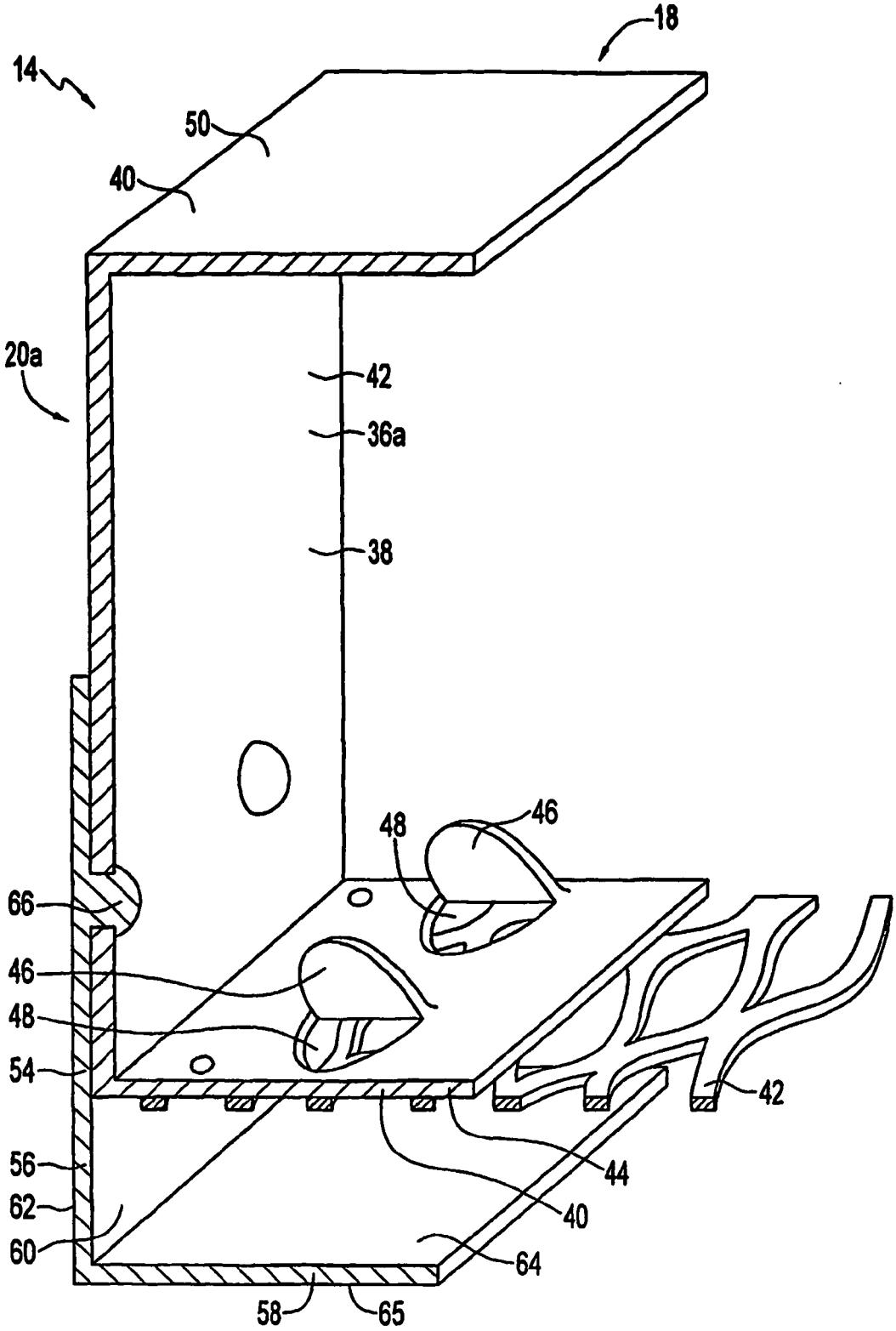
FIG. 8 is a partial perspective view of the outer member attached to the frame for a composite panel of FIG. 1.

Referring now to FIGS. 7 and 8, the frame 14 is preferably fabricated by attaching the members 34 together with fasteners such as screws, rivets or any other method. A reinforcing layer, such as slit and expanded metal lath 42, or wire mesh or other reinforcement known in the art, is also used to connect the frame members 34 into a frame 14, as will be further described below.

Figure 9:
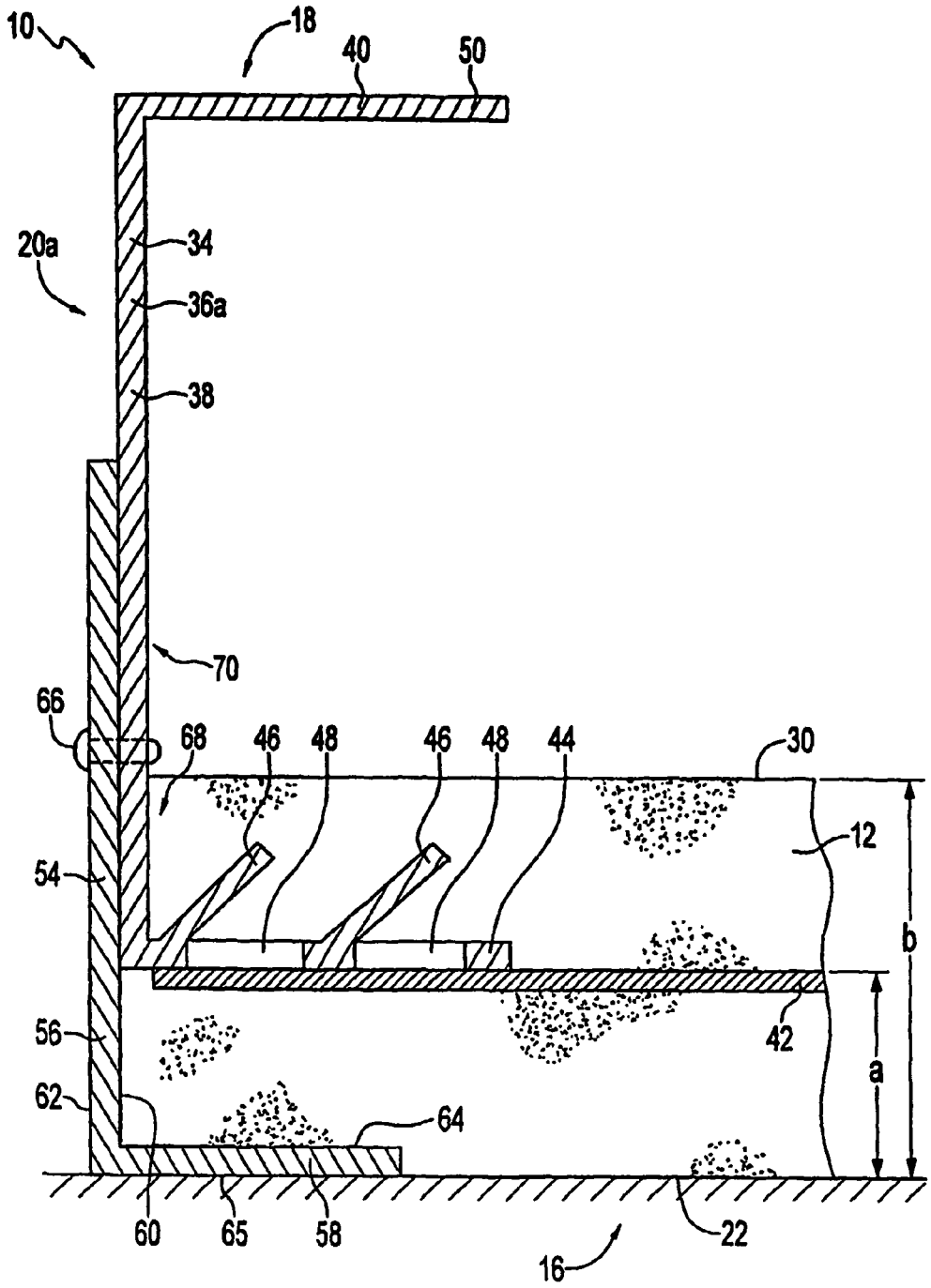
FIG. 9 is a partial cross section of the composite panel of FIG. 1 on the pouring pad.

The frame members 34 preferably include a first flange 44 having at least one tab 46 providing a tab opening 48 to receive concrete. The first flange 44 preferably has a plurality of tabs 46 that are punched, such as by using a die, and are generally circular. Each tab 46 is angled approximately 30-degrees from the first flange 44 towards an opposing second flange 50, however, other orientations, placements and directions are contemplated. For example, FIGS. 7 and 9 show two different orientations, placements and directions of tabs 46. It is also contemplated that the tab 46 can be bent such that the tab itself is non-planar, which can be done to provide additional anchoring in the concrete 12. After the tabs 46 are punched into the member 34, the members can be assembled into the frame 14.

Assembly of the frame 14 requires the members 34 to be attached to each other in a desired arrangement. Preferably, the members 34 are fastened in arrangement at or near a pouring pad 52. As is known in the art, the pouring pad 52 is a conventional, planar, horizontal surface that is used, typically with forms, in the fabrication of precast concrete structures.

Preferably, the C-channel frame members 34 are positioned in a parallel arrangement and laid on their respective second, untabbed flanges 50, while the first, tabbed flanges 44 face upwards (as seen in FIG. 7). The peripheral frame members 36*a*, 36*b*, 36*c*, 36*d* are positioned around the remaining frame members 34 such that they are on the periphery of the frame 14. Once in the desired arrangement with respect to adjacent frame members 34, the adjacent frame members are attached to one another using screws, rivets, welding or any other fastening methods.

Metal lath 42 is laid across the first flange 44, preferably on the planar side of the flange, and is secured to the frame member 34 with screws, ties, spot welding or any other fastening method. To further secure the reinforcing layer into place, it is contemplated that strips of metal can be laid and fastened on top of the layer to sandwich the reinforcing layer between the metal strip and the frame. Preferably, the metal lath 42 is similarly laid across and secured to other frame members 34 to provide reinforcement throughout the frame 14.

Still referring to FIG. 7, it will be appreciated that when the frame members 34 are first assembled into the frame 14, the second flanges 50 are oriented on the pouring pad 52. It will further be appreciated that the first flange 44, which faces upwards and has the tabs 46 punched therein, will later be embedded in the concrete slab 12.

Either before or after all frame members 34 are attached as part of the frame 14, outer members 54 are positioned immediately adjacent to at least one, but preferably all the peripheral frame members 36*a*, 36*b*, 36*c*, 36*d* such that the outer members bound at least one edge, but preferably the entire frame 14 of the panel 10.

Preferably made of light gauge metal or plastic, the outer members 54 are removably attached to the peripheral frame members 36*a*, 36*b*, 36*c*, 36*d*, to preferably become part of the panel 10. With the outer members 54 attached, the panel has dimensions $l_1'$, $l_2'$, and $l_3'$ similar to $l_1$, $l_2$, and $l_3$. Further, as will become apparent later, the outer members 54 function as forms to retain the concrete within the area bounded by the outer members, as spacers to hold the first flange at the desired location within the slab, as optional edge protectors, and as optional structural members.

The outer members 54 are preferably generally L-shaped with a vertical leg 56 and a horizontal leg 58, although other configurations are contemplated. In the preferred embodiment, the vertical leg 56 of the preferably L-shaped outer member 54 is positioned to abut the peripheral frame members 36*a*, 36*b*, 36*c*, 36*d* while the horizontal leg 58 of the outer member 54 extends over the top of the first flange 44. Although the assembly of the panel using an L-shaped outer member 54 will be more particularly described herein, other outer member shapes are contemplated.

On the vertical leg 56, the outer members 54 have an inner surface 60 which abuts the web 38 of the peripheral frame members 36*a*, 36*b*, 36*c*, 36*d*, and an outer surface 62 which outwardly faces the frame members 34. On the horizontal leg 58, the outer members 54 have an inner surface 64 which faces the first flange 44 of the peripheral frame members 36*a*, 36*b*, 36*c*, 36*d* and an outer surface 65 which outwardly faces the frame members 34. Spaced a select distance apart, the planar surface of the first, or tabbed flange 44 is parallel to and faces an inner surface 64 of the horizontal leg 58 of the outer member 54. In this configuration, the C-shape of the channel member 34 is positioned within the L-shape of the outer member 54. Alternatively, it is contemplated that any shape frame member 34 can be positioned within any shape of outer member 54.

The vertical leg 56 of the outer member 54 preferably has a height $h_2$ that exceeds the desired concrete slab thickness b (FIG. 9). When the outer member 54 is positioned abutting the frame member 34, the horizontal leg 58 is held a distance, or first depth a, away from the planar surface of the first flange (FIG. 7). This first depth a is the distance between the horizontal leg 58 and the planar surface of the first flange 44 and is preferably about one-inch, although the thickness can vary to suit the application.

The outer member 54 is secured into position relative to the peripheral frame member 36*a* in order to maintain the first depth a. Preferably, screws or other removable fasteners 66 are inserted from the outer surface 62 of the outer member 54 through the outer members and into the frame member 34 to attach the form to the peripheral frame member 36*a*, although other fastening methods are envisioned. In the preferred embodiment, the screws 66 are positioned such that they are above the level to be embedded in the concrete. However, it should be understood that the screws 66 can be in located anywhere that will allow the outer members 54 to be securely fastened to the peripheral frame members 36*a*, 36*b*, 36*c*, 36*d*.

In an alternate embodiment, the outer members 54 have a complementary shape to the peripheral frame members 36*a*, 36*b*, 36*c*, 36*d* such that they can be snapped, pressure fit, or otherwise connected together. Further, the outer member 54 can have connectors disposed thereon to engage the peripheral frame member 36*a* (FIG. 8). In this embodiment, the outer members are preferably made of plastic or any other resilient material. Further, it is contemplated that other methods of attachment, both permanent and removable can be used.

As discussed with respect to the peripheral frame members 36*a*, 36*b*, 36*c*, 36*d*, it is also contemplated that additional outer members 54 may be placed in the interior of the frame 14 at frame members 34 to prevent the concrete from flowing into predetermined locations, such as locations configured to be openings 32 for windows, doors and ventilation. At these locations, the outer members 54 are preferably positioned and secured in the same manner as the peripheral frame members 36*a*, 36*b*, 36*c*, 36*d* to prevent the flow of concrete within these locations. Additionally, other ways of preventing concrete from filling in the openings, such as by placing the frame 14 up against a conventional form, by placing inserts to block the flow of concrete, or other methods known in the art, are contemplated. Yet another way that is contemplated for forming the openings is to let the aerated concrete settle in the openings, and to later cut the concrete from the openings.

As previously discussed, the typically planar concrete slab 12 is oriented toward the front 16 of the panel 10 and the frame 14 is oriented toward the back 18 of the panel. After the frame 14 is assembled and the outer members 54 are attached in their upside-down orientation, the frame 14 is flipped over generally 180-degrees such that the horizontal legs 58 engage and rest on the pouring pad 52 and, further, the outer members 54 hold the frame 14 uniformly spaced above the pouring pad (as seen in FIG. 8). The frame 14, now with the first flanges 44 and the metal lath 42 oriented to be planar with and adjacent to the pouring pad 52, has an opposite orientation from when the frame is initially assembled. In this second orientation, the frame 14 and the outer member 54 are right-side up. Further, although it is preferable that the outer members 54 have the horizontal leg 58 to rest on the pouring pad 52, any shape of outer member that will hold the frame 14 over the pouring pad while retaining concrete within the area bounded by the outer member is contemplated.

The distance that the frame 14 is held above the pouring pad 52 is the distance a and is generally uniform throughout the frame members 34. However, it is contemplated that the distance between the frame members 34 and the pouring pad 52 can vary, if desired.

Between the outer members 54 and the pouring pad 52, an area is bounded within which uncured concrete is poured to form the concrete slab 12. While fabrication of conventional concrete panels requires that a concrete molding form be removably attached to the frame for retaining the concrete within the confines of the form, the present invention does not require a molding form. Since the outer members 54 define the bounds in which the concrete is formed, the panel is a self-contained member that does not require the assembly and disassembly of forms in the concrete pouring step. Further, since the outer members 54 are attached to the frame 14 while the frame is upside down, spacing the frame 14 over the pouring pad can be done more accurately and uniformly.

Referring back to the fabrication of the composite panel 10, while the frame 14 is held the distance a above the pouring pad 52 by the outer members 54, the aerated concrete slurry is fed through a hose, or other known methods for placing aerated concrete. Since the density of aerated concrete is lower than that of standard concrete, the aerated concrete is poured and worked with much less effort than required for conventional concrete. More particularly, aerated concrete will substantially self-leveling, reducing the amount of manual working of the concrete.

Settling at the pouring pad 52, the aerated concrete increases in depth as more slurry is fed through the hose. In accordance with the preferred embodiment, at the depth a of approximately one-inch, the aerated concrete will reach the first flange 44, and at depth b of approximately two-inches, the aerated concrete will reach a height in which the first flange, including the tabs 46, will be fully encapsulated. The portion of the frame member 34 which is embedded at a depth b is an embedded portion 68 of the frame, while the portion that is not embedded is an exposed portion 70 of the frame.

The aerated concrete, easily passes through the tab openings 48 in the flange 40 formed by the tabs 46 without the need for vibration. When the concrete in the tab openings 48 cures, the configuration will provide additional anchoring of the frame 14 within the concrete slab 12. Further, the aerated concrete can easily settle within the openings of the reinforcing layer, particularly holes in the expanded metal lath 42. However, dense concrete can also be used if there is sufficient working and vibration of the material. The concrete in the holes of the metal lath 42 secures the frame reinforcement within the concrete slab 12, lessens the likelihood of shearing or pullout.

Although it is preferred that the frame 14 is assembled and then flipped over so that it is spaced above the pouring pad on the outer members 54, it is also contemplated that the frame can be pushed down into a bed of poured concrete. However, several disadvantages exist in pushing the frame 14 into the concrete, such as non-uniformity of the depth that the frame is pushed into the concrete. Additionally, problems arise during installation when individual panels 10 are not fabricated to be substantially uniform (i.e. not uniformly embedded). For these reasons, it is advantageous to assemble the frame 14, attach it to the outer members 54, and flip it over before pouring the concrete.

After curing for preferably 12-24 hours, the panel 10, with the outer members 54 attached, can be lifted from the pouring pad 52. The composite panel 10 is preferably cured for a period of at least seven days before the panel is transported.

It is preferable that the outer members 54 remain secured to the composite panel 10 for protection of the panel edges during transport from the fabrication facility to a construction site. Transport or other handling of the composite panels 10 from the fabrication facility to the construction site can damage the panels, particularly the edges or corners of the concrete slab 12. For this reason, the outer members 54 protect the panels 10 at the periphery. Further, it is contemplated that the outer members 54 can be made of a material that provides durability as well as cushioning, such as extruded plastics.

When the panels 10 are delivered to the construction site, the outer members 54 are preferably removed from the panel 10 for installation. Alternatively, the outer members 54 can be removed at the fabrication site. Removal of the outer members 54 is accomplished by unfastening the removable fasteners 66 and stripping the outer members 54. FIG. 4 shows the outer members 54 removed from the panel 10.

Figure 11:
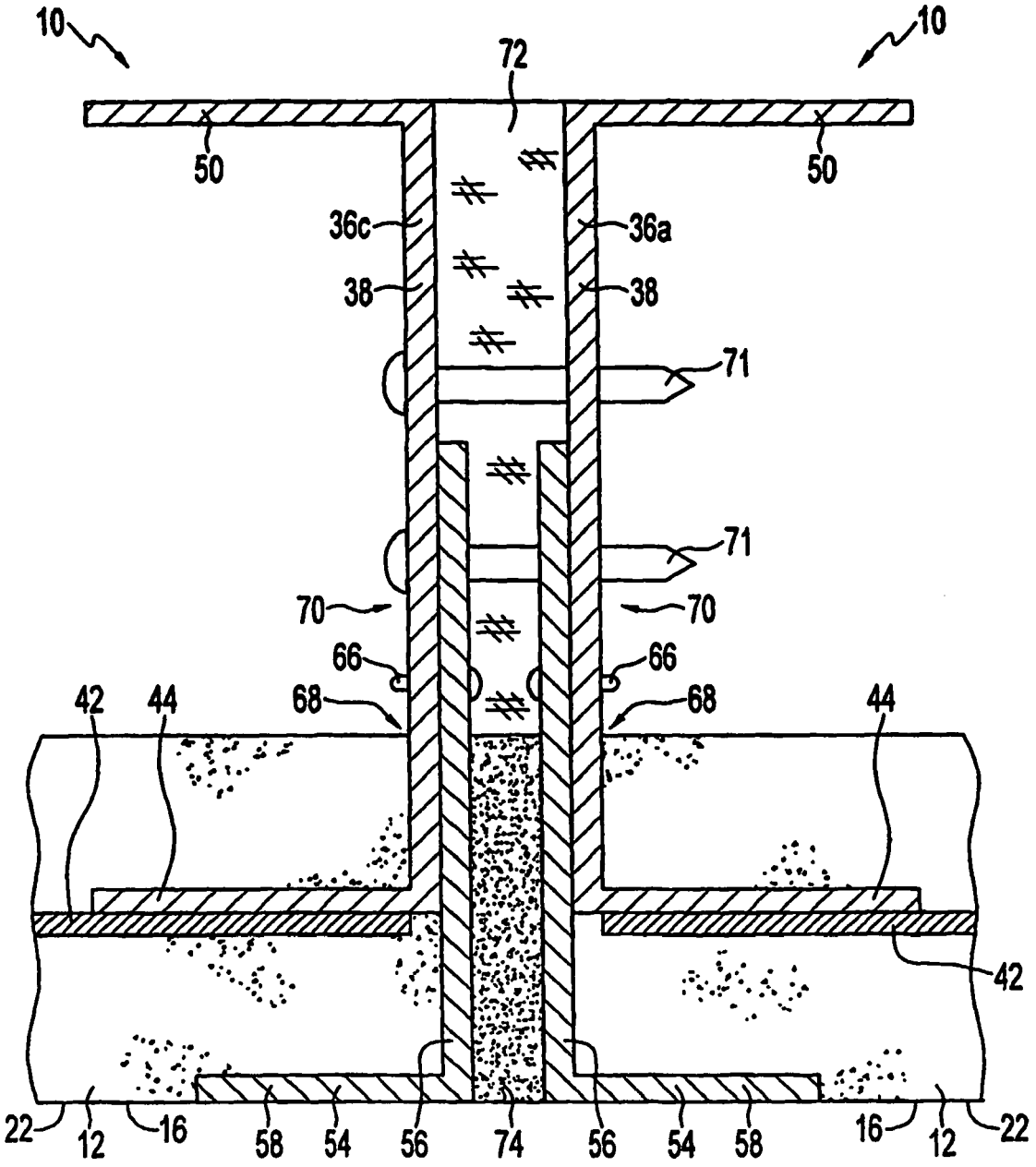
FIG. 11 is a partial cross-section of two composite panels of FIG. 1 fastened together with the outer members attached.

Alternatively, and as shown in FIG. 1, the outer members 54 can remain secured to the panel 10 (or are optionally permanently secured to the panel at the frame assembly stage) at installation. With reference to FIG. 11, when the panels are installed on the structure, the outer members 54 of adjacent composite panels 10 are preferably fastened together with a fastener 71, such as with a screw or other known fasteners. It is contemplated that the panels can be fastened to one another or to the structure by any conventional methods.

Figure 10:
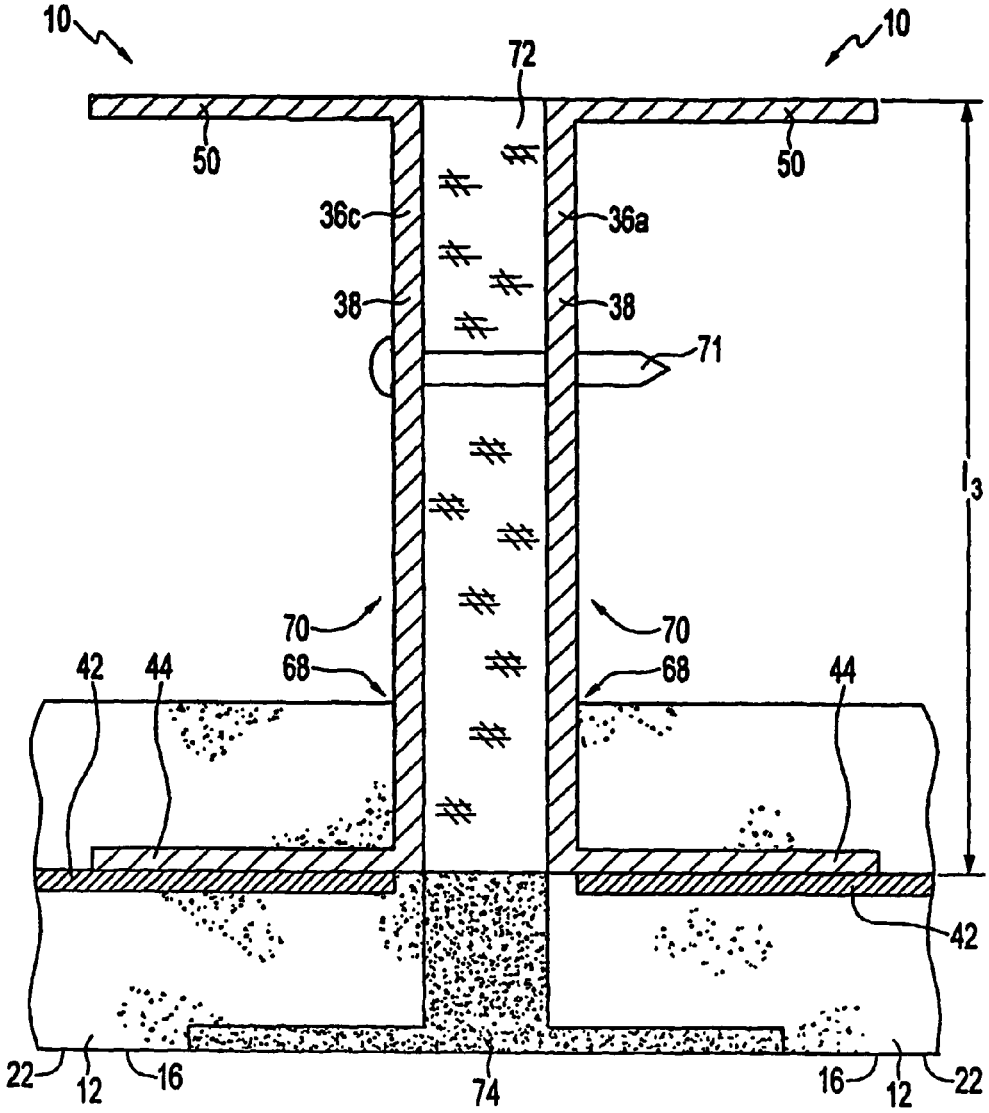
FIG. 10 is a partial cross-section of two composite panels of FIG. 1 fastened together with the outer members removed.

When the panels 10 are installed on a structure, an insert 72, such as an insulating strip of polystyrene, or any other insulating material, is preferably disposed between two adjacent panels 10 to prevent the flow of air between the panels (FIGS. 10 and 11). In the preferred embodiment of FIG. 10, the outer members 54 are removed and the insert 72 is disposed along the entire length $l_3$ of the frame 14. Alternatively, as shown in FIG. 11, the insert 72 can be disposed between the outer members 54 and can extend a length shorter or longer than the length $l_3$ of the frame 14.

Further, a seal 74, such as grout or sealant, is preferably placed between the panels 10 at the front face 16 to provide a finished appearance at the junction of adjacent panels. The seal 74 can also extend over the outer members 54 to the front surface of the slab 22 to give the appearance of a continuous panel. With respect to panel 10 with the outer members removed (FIG. 10), the seal 74 can fill in the detent of the concrete slab 12 that remains when the members are removed. Further, it is preferred that the seal 74 have little or no contact with the frame 14 to prevent unwanted thermal conductivity from the seal to the frame. In this manner, the concrete slab 12 of aerated concrete forms a thermal barrier between the frame 14 and the ambient. However, as seen from FIG. 11, other seal 74 and insert 72 configurations are contemplated.

The method of fastening the panels 10 together preferably includes the steps of placing the peripheral frame members 36, for example 36*a* and 36*c*, in an opposing arrangement, disposing the insert 72 between the peripheral frame members, fastening the peripheral frame members together with the fastener 71 with the insert sandwiched between the frame members, and disposing the seal 74 between the peripheral frame members near the front face 16 of the panel. However, it is contemplated that any method of sealing the gap between panel 10 may optionally be employed.

It will further be appreciated by those skilled in the art that the size and configuration of the frame members 34, in addition to the type and amount of concrete used, will vary to suit the use. For example, a wall that is intended to bear a large load will require different frame and concrete characteristics than a wall that is intended to bear a small load. Additionally, it is contemplated that the aerated concrete may be reinforced by skin stressing to improve the strength. Further, conventional methods used to texture the front face 16 of the panel 10 may be employed.

While specific embodiments of the composite frame of the present invention have been shown and described, it will be appreciated by those skilled in the art that changes and modifications may be made thereto without departing from the invention in its broader aspects and as set forth in the following claims.

What is claimed is:

1. A prefabricated composite wall panel for the exterior wall of a structure, comprising:

a single concrete slab having an exterior face configured to be exposed to the ambient exterior of the structure and an interior face configured for the interior of the structure;

a plurality of spaced apart C-shaped, metal frame members having a web, a first flange continuous with and projecting orthogonally from one end of said web, and a second flange continuous with and projecting orthogonally from a second end of said web, said first flange being fully embedded in said concrete slab, said one end of said web being embedded in said slab and said web projecting from said interior face of said slab, and said second flange being non-embedded in concrete and spaced apart from the interior surface of said concrete slab; and a metal lathe reinforcing layer mechanically fastened to said first flange of at least one of said frame members and being fully embedded in said concrete slab;

wherein said concrete slab has a density of 960 to 1360 $kg/m^3$ (60 to 85 pcf) and a strength from 3.45 to 20.07 kPa (500 to 3000 psi) and includes entrained air that lowers the thermal conductivity of the slab and forms a thermal barrier between said metal frame members and the ambient exterior of the structure.

2. The prefabricated composite wall panel of claim 1 wherein said concrete slab comprises a foaming agent.

3. The prefabricated composite wall panel of claim 1 wherein said first flange includes a plurality of openings, said concrete slab extending through said openings.

4. The prefabricated composite wall panel of claim 1 wherein said reinforcing layer comprises slit and expanded metal lath.

5. The prefabricated composite wall panel of claim 1 further comprising at least one opening in the panel which is at least partially bounded by said frame members.

6. The prefabricated composite wall panel of claim 1 further comprising at least one outer member on an outer edge of said panel, said outer member having two legs, one of said legs adjacent to and removably attached to said web.

* * * * *